US006134737A

United States Patent [19]

Remme

[11] Patent Number: 6,134,737

[45] Date of Patent: Oct. 24, 2000

[54] INFANT ORAL HYGIENE DEVICE

[76] Inventor: Deborah L. Remme, 4601 Robertson Ave., Sacramento, Calif. 95821

[21] Appl. No.: 09/262,964

[22] Filed: Mar. 4, 1999

[51] Int. Cl.[7] ..... A46B 9/04

[52] U.S. Cl. ..... 15/110; 15/167.1; D4/108

[58] Field of Search ..... 15/110, 167.1; 601/139; 606/234, 235, 236; D4/104, 107, 108; D24/194

[56] References Cited

U.S. PATENT DOCUMENTS

| | | | |
|---|---|---|---|
| D. 180,164 | 4/1957 | Tupper . | |
| D. 383,307 | 9/1997 | Klein et al. . | |
| D. 421,185 | 2/2000 | Remme . | |
| 2,273,207 | 2/1942 | Kuhn | 15/167.1 |
| 3,267,937 | 8/1966 | Verschoor . | |
| 3,753,266 | 8/1973 | Ceniceros . | |
| 4,654,921 | 4/1987 | Dinner | 15/167.1 |
| 5,048,143 | 9/1991 | Carroll . | |
| 5,078,732 | 1/1992 | Ceniceros . | |
| 5,138,737 | 8/1992 | Thomas | 15/167.1 |
| 5,291,878 | 3/1994 | Lombardo et al. . | |
| 5,511,273 | 4/1996 | Carroll . | |
| 5,623,739 | 4/1997 | Thompson | 15/167.1 |
| 5,729,859 | 3/1998 | Guffin, III . | |

*Primary Examiner*—Terrence R. Till
*Attorney, Agent, or Firm*—Thomas R. Lampe

[57] ABSTRACT

An oral hygiene device for use by an infant has a toothbrush bristle support and teething member interconnected by spaced curved handles. The handles, teething member and toothbrush bristle support form an opening for an infant's hand and are disposed in a common plane. Toothbrush bristles are attached to the toothbrush bristle support and extend in the direction of the plane.

11 Claims, 2 Drawing Sheets

INFANT ORAL HYGIENE DEVICE

TECHNICAL FIELD

This invention relates to an oral hygiene device for use by an infant. More particularly, the device incorporates structure allowing an infant to stimulate his or her gums and to brush teeth.

BACKGROUND OF THE INVENTION

A number of devices are known in the prior art for use by infants or small children as either teethers or toothbrushes. The following patents are believed to be representative of the current state of the art in this field: U.S. Pat. No. 5,048,143, issued Sep. 17, 1991, U.S. Pat. No. 5,729,859, issued Mar. 24, 1998, U.S. Pat. No. 5,291,878, issued Mar. 8, 1994, U.S. Pat. No. 5,078,732, issued Jan. 7, 1992, U.S. Pat. No. 5,511,273, issued Apr. 30, 1996, and U.S. Pat. No. 3,753,266, issued Aug. 21, 1973.

DISCLOSURE OF INVENTION

The invention disclosed and claimed herein is characterized by its relative simplicity, ease of use and effectiveness as either a teether or a toothbrush. The device incorporates a number of features which make it particularly suitable for use by an infant from both the standpoints of safety and efficaciousness.

The oral hygiene device of the present invention is for use by an infant. The term infant as employed herein encompasses any young child.

The device includes a toothbrush bristle support and a teething element for engaging the gums of an infant.

The toothbrush bristle support and the teething element are spaced from one another.

A first manually graspable handle segment extends between and interconnects the toothbrush bristle support and the teething element.

A second manually graspable handle segment also extends between and interconnects the toothbrush bristle support and the teething element, the first and second manually graspable handle segments being spaced from one another.

The first and second manually graspable handle segments, the toothbrush bristle support and the teething element define an opening for receiving an infant's hand so that the infant can grasp one or both of the first and second manually graspable handle segments to support and manipulate the oral hygiene device. The first and second manually graspable handle segments, the toothbrush bristle support and the teething element are disposed along a common plane.

The device further includes a plurality of toothbrush bristles attached to and projecting outwardly from the toothbrush bristle support in a direction substantially corresponding to the direction of the common plane.

Other features, advantages, and objects of the present invention will become apparent with reference to the following description and accompanying drawings.

MODES FOR CARRYING OUT THE INVENTION

Referring to FIGS. 1–6 of the drawings, an oral hygiene device 5 constructed in accordance with the teachings of the present invention includes a toothbrush bristle support 10, a teething element 12 and two manually graspable handles 14, 16 spaced from one another and extending between and interconnecting the toothbrush bristle support and the teething element.

Figure 1:
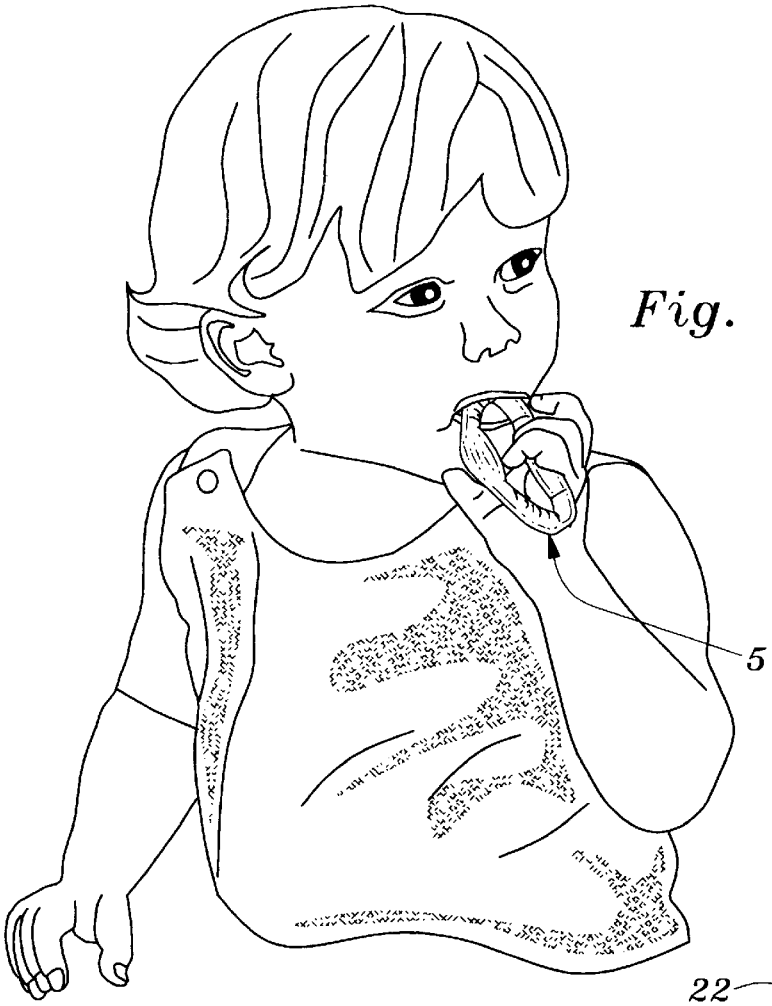
FIG. 1 is a perspective view illustrating an oral hygiene device constructed in accordance with the teachings of the present invention being held and used by an infant.
Figure 2:
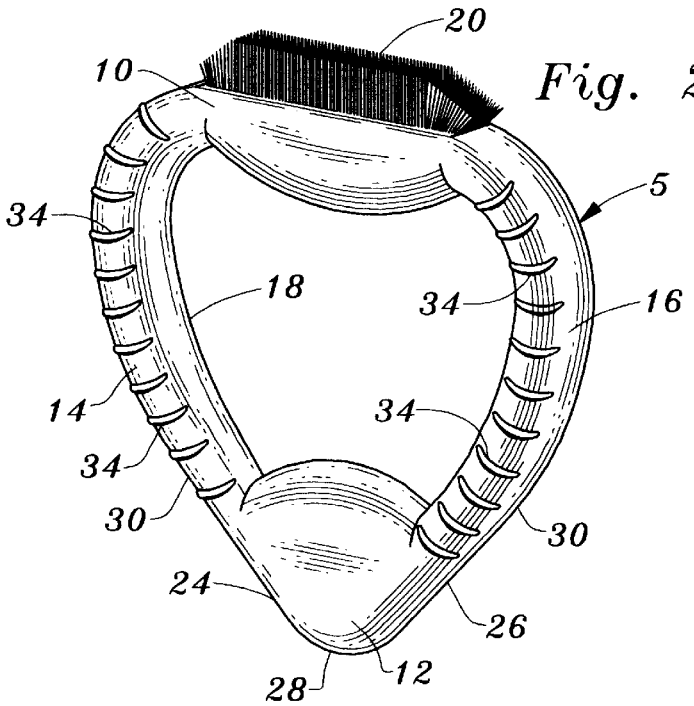
FIG. 2 is an enlarged perspective view of the device.
Figure 3:
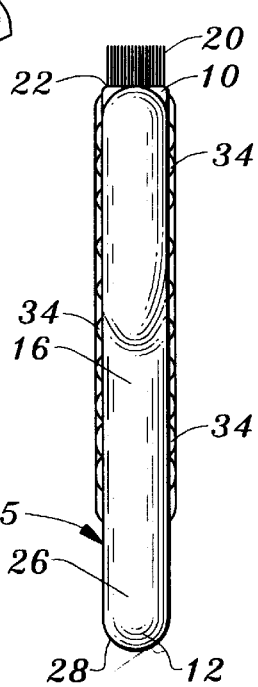
FIG. 3 is a side view of the device.
Figure 4:
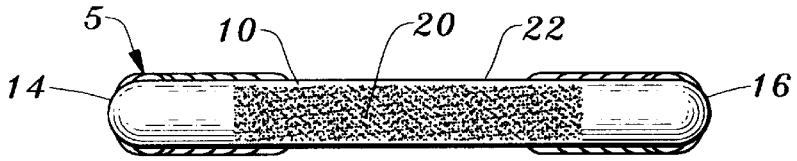
FIG. 4 is a top plan view of the device.
Figure 5:
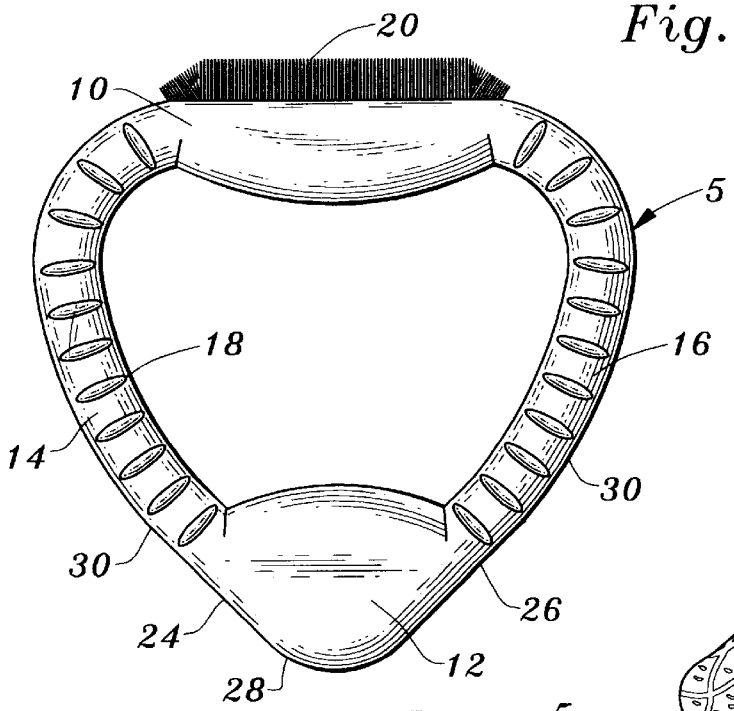
FIG. 5 is a front elevational view of the device.
Figure 6:
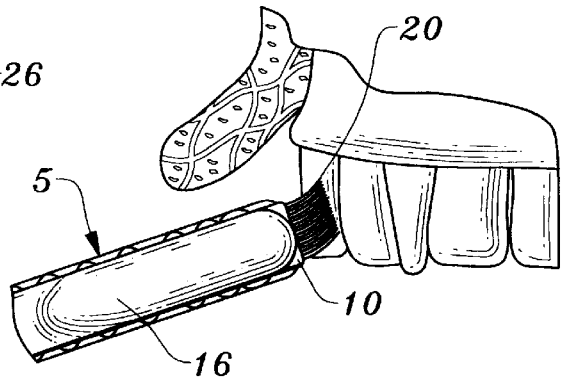
FIG. 6 is a side view illustrating a portion of the device cleaning teeth.

The manually graspable handles 14, 16, the toothbrush bristle support 10 and the teething element 12 define an opening 18 for receiving an infant's hand so that the infant can grasp one or both of the handles to support and manipulate the oral hygiene device. FIG. 1 illustrates the device 5 being held by an infant.

The toothbrush bristle support, teething element and handles are of integral construction, being molded in one piece from rubber or other suitable soft, pliable, resilient material.

The manually graspable handles, the toothbrush bristle support and the teething element are disposed along a common plane. Toothbrush bristles 20 are attached to and project outwardly from the toothbrush bristle support. The toothbrush bristle support is elongated and includes an elongated, substantially straight outer surface 22 from which the plurality of toothbrush bristles project. The surface 22 is disposed substantially orthogonal to the common plane occupied by the toothbrush bristle support, the teething element and the handles and the toothbrush bristles project outwardly in a direction corresponding to the direction of the common plane. This is an important feature since the bristles can be readily positioned and employed by an infant (or an infant's caregiver) to clean anterior/front teeth (first erupted teeth). See FIG. 6. The bristles can be used for stimulation during teething or to remove plaque from the erupted teeth. The toothbrush bristle support is somewhat enlarged as compared to the handles to provide sufficient backup support for the bristles during use. Because of the location and orientation of the bristles they can be moved through a wide range of motion.

Teething element 12 comprises a pad including a pair of outer pad surfaces 24, 26 which converge toward one another to form a tapered distal pad end 28. The pad is substantially flat at the front and back surfaces thereof and has a smooth outer surface. The taper of the teething pad allows the distal end thereof to be inserted in the mouth and provides a chewing surface to minimize discomfort during teething.

It should be noted that the end portions 30 of the manually graspable handles 14, 16 are actually continuations of the outer pad surfaces 24, 26 and diverge away from one another as they extend from the pad. The configuration of the pad and the handle end portions 30 is relatively wide as compared to the distal end 28 of the pad so that the device cannot be over-inserted into the user's mouth. The overall appearance of the device is that of a heart, the handles arching away from one another between the pad and toothbrush bristle support; that is, the toothbrush bristle support, the teething element and the two handles cooperate to form a generally heart-shaped configuration.

Spaced ribs 34 are integrally formed with the handles and extend along substantially the full lengths of the handles. The ribs are formed of the same soft, pliable, resilient material of which the toothbrush bristle support, the teething element, and the handles are made. The ribs may be utilized in a teething function for providing gum massage and stimulation. The ribs fulfill the additional function of being engageable by the infant's hand when grasping the handles to reduce the chance of slippage or dropping the device.

Figure 8:
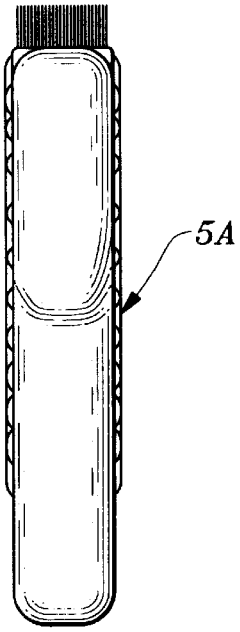
FIG. 8 is a view similar to FIG. 3 of the alternative embodiment.
Figure 7:
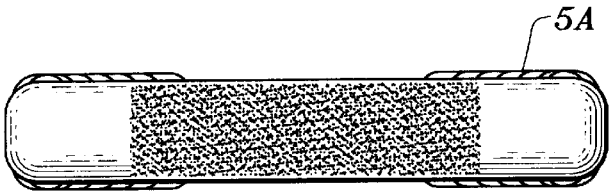
FIG. 7 is a view similar to FIG. 4 illustrating a wider alternative embodiment of the device.

FIGS. 7 and 8 show an alternate embodiment 5A of the device which is wider than device A but the same in all other respects.

What is claimed is:

1. An oral hygiene device for use by an infant, said oral hygiene device comprising, in combination:

a toothbrush bristle support;

a teething element for engaging the gums of an infant, said toothbrush bristle support and said teething element being spaced from one another;

a first manually graspable handle extending between and interconnecting said toothbrush bristle support and said teething element;

a second manually graspable handle extending between and interconnecting said toothbrush bristle support and said teething element, said first and second manually graspable handles being spaced from one another, said first and second manually graspable handles, said toothbrush bristle support and said teething element defining an opening for receiving an infant's hand so that the infant can grasp one or both of said first and second manually graspable handles to support and manipulate said oral hygiene device, and said first and second manually graspable handles, said toothbrush bristle support and said teething element being disposed along a common plane; and a plurality of toothbrush bristles attached to and projecting outwardly from said toothbrush bristle support in a direction substantially corresponding to the direction of said common plane, said teething element comprising a soft and resilient pad having a pair of outer pad surfaces converging toward one another to form a tapered distal pad end and said first and second manually graspable handles including handle end portions attached to said pad, said handle end portions diverging from one another from said pad.

2. The oral hygiene device according to claim 1 wherein said toothbrush bristle support, said teething element and said first and second manually graspable handles are of integral construction.

3. The oral hygiene device according to claim 2 wherein said toothbrush bristle support, said teething element and said first and second manually graspable handles are formed of soft, pliable, resilient material.

4. The oral hygiene device according to claim 1 wherein said first and second manually graspable handles are curved and wherein said toothbrush bristle support, said teething element and said first and second manually graspable handles cooperate to form a generally heart-shaped configuration.

5. The oral hygiene device according to claim 1 wherein said toothbrush bristle support is elongated and includes an elongated, substantially straight outer surface from which said plurality of toothbrush bristles project, said elongated substantially straight outer surface of said toothbrush bristle support being disposed substantially orthogonal to said common plane.

6. The oral hygiene device according to claim 1 wherein the lengths of said first and second manually graspable handles are substantially identical, said first and second manually graspable handles arching away from one another between said toothbrush bristle support and said teething element.

7. The oral hygiene device according to claim 1 additionally comprising a plurality of spaced ribs connected to each of said first and second manually graspable handles for resisting slippage of an infant's hand grasping said first and second manually graspable handles.

8. The oral hygiene device according to claim 1 additionally comprising a plurality of soft, resilient projections for massage and stimulation of an infant's gums connected to at least one of said first and second manually graspable handles.

9. The oral hygiene device according to claim 8 wherein said soft, resilient projections comprise ribs extending at least partially about the periphery of at least one of said first and second manually graspable handles.

10. The oral hygiene device according to claim 1 wherein said toothbrush bristle support and said teething element are disposed at opposed ends of said device, the end at which said toothbrush bristle support is located being larger than the end where said teething element is disposed.

11. An oral hygiene device for use by an infant, said oral hygiene device comprising, in combination:

a toothbrush bristle support;

a teething element for engaging the gums of an infant, said toothbrush bristle support and said teething element being spaced from one another;

a first manually graspable handle extending between and interconnecting said toothbrush bristle support and said teething element;

a second manually graspable handle extending between and interconnecting said toothbrush bristle support and said teething element, said first and second manually graspable handles being spaced from one another, said first and second manually graspable handles, said toothbrush bristle support and said teething element defining an opening for receiving an infant's hand so that the infant can grasp one or both of said first and second manually graspable handles to support and manipulate said oral hygiene device, and said first and second manually graspable handles, said toothbrush bristle support and said teething element being disposed along a common plane; and a plurality of toothbrush bristles attached to and projecting outwardly from said toothbrush bristle support in a direction substantially corresponding to the direction of said common plane, said toothbrush bristle support and said teething element being disposed at opposed ends of said device, and the end at which said toothbrush bristle support is disposed being larger than the end where said teething element is disposed.

* * * * *